United States Patent [19]

Postich

[11] 4,431,408

[45] Feb. 14, 1984

[54] STACKABLE DISTORTION RESISTANT FURNACE BASKET

[75] Inventor: Salvester Postich, Simpsonville, S.C.

[73] Assignee: Carolina Commercial Heat Treating, Inc., Fountain Inn, S.C.

[21] Appl. No.: 351,183

[22] Filed: Feb. 22, 1982

[51] Int. Cl.[3] ..... B65D 21/00; F27B 14/10

[52] U.S. Cl. ..... 432/261; 206/513; 220/19

[58] Field of Search ..... 432/261; 206/513; 220/19

[56] References Cited

U.S. PATENT DOCUMENTS

| | | | |
|---|---|---|---|
| 2,807,454 | 9/1957 | Beadle | 432/261 |
| 3,395,810 | 8/1968 | Johnson | 206/513 |
| 3,869,060 | 3/1975 | Goyheneix | 220/19 |

*Primary Examiner*—John J. Camby

*Attorney, Agent, or Firm*—Dority & Flint

[57] ABSTRACT

A high-temperature furnace basket 10 is disclosed for carrying work pieces during heat treatment. The basket includes a top rim A and a bottom rim B interconnected by frame sides 20*a*, 20*c* and ends 20*b*, 20*d*. Rim A includes a closed loop 12 having an uninterrupted load bearing surface 16 around the entire perimeter of the basket. Rim B includes closed loop 14 having an uninterrupted contacting rim surface 18. When stacked, contact around the total perimeter of the basket is provided between rim surfaces 16 and 18 to evenly distribute the load of stacked baskets under high temperature loads and stresses. Staggered retaining devices 54, 56 and 58,60 provide inverted stacking as well as normal stacking.

10 Claims, 6 Drawing Figures

STACKABLE DISTORTION RESISTANT FURNACE BASKET

BACKGROUND OF THE INVENTION

The invention relates to basket devices of an open wire construction in which work pieces are carried for heat treatment in furnaces typically at temperatures to 2300 degrees F. Because of the extreme heat environment in which the baskets are utilized and due to the fact that the baskets are often stacked upon each other in the furnace, heat and load distortions on the baskets is a problem to which considerable attention need be given. When the basket becomes distorted the sides and ends may sag, rendering the stacking of the baskets unstable. The work pieces often become relocated and bunched in the basket. Under such conditions, the life of the basket is considerably shortened.

Heretofore, work handling baskets for high temperature furnaces have been fabricated by welding together in crossing relation suitable forms of heavy wound or flat strips of wire. Typically baskets include some form of a stacking brace on opposing basket sides which permits the baskets to be stacked and holds them in place such as in U.S. Pat. No. 2,807,454. However, the problem exists that the contacting surfaces of the stacked baskets do not evenly distribute the basket load and distortion of the basket occurs. This distortion normally results in the sides of the basket sagging inwardly and the ends of the basket sagging inwardly or outwardly. Thus, the stacking configuration of the baskets becomes wobbly and unstable.

Accordingly, an important object of the present invention is to provide a work handling basket for high temperature furnaces in which basket distortion due to ununiform load distribution is substantially reduced.

Yet another important object of the present invention is to provide a furnace basket for heat treating work pieces which permits maximum loading with minimum basket weight without adversely affecting the life of the basket.

Still another important object of the present invention is to provide a furnace basket for heat treating of work pieces which provides total perimeter contact and load bearing between stacked basket surfaces.

Still another important object of the present invention is to provide a high temperature furnace basket having stacking devices which permit stacking and interlocking of the baskets when the baskets are inverted in a top-to-top configuration as well as permits normal stacking of the baskets in a bottom-to-top relationship.

SUMMARY OF THE INVENTION

The above objectives are accomplished according to the present invention by providing a furnace basket having a top rim member defined by a continuous closed loop having an uninterrupted rim surface around the entire perimeter of the open top of the basket and an identical bottom rim member defined by a continuous closed bottom rim loop having an uninterrupted bottom rim surface around the entire perimeter of the bottom of the basket. The top and bottom rim members are vertically aligned and co-extend about the basket perimeter. Total perimeter contact is provided between opposing rim surfaces when the baskets are stacked either bottom-to-top or top-to-top. The floor of the basket bottom is provided by an open wire grid. When the baskets are positioned in an inverted top-to-top stacked configuration, elongated work piece articles may be held in the open mesh of the grid and supported in a generally vertical orientation. Staggered stacking devices on the basket retain the basket in a stacked configuration and engage respective rim members to resist lateral sagging of the basket sides and ends. The stacking devices are staggered so that the basket may be stacked in the normal configuration or inverted configuration. By providing total contacting rim members substantially eliminating basket distortion due to uneven loading under high temperature and load stresses.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

Figure 1:
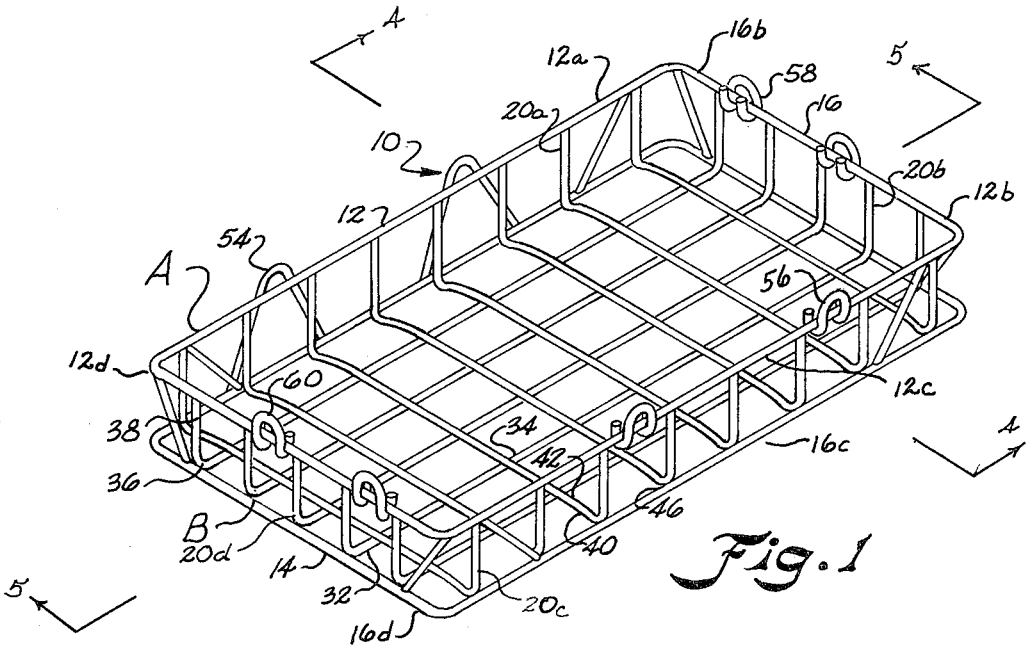
FIG. 1 ia a perspective view illustrating a high temperature furnace basket constructed according to the present invention.

Referring now to the drawings, a stackable distortion resistant furnace basket is illustrated as including an open top and a closed bottom defined by an open grid floor. A top rim member A extends around the entire perimeter of the open top of the basket. A bottom rim member B extends around the entire perimeter of the bottom of the basket. Frame means C includes vertical sides and ends which connect the top and bottom rim members around the entire periphery of the basket. The top and bottom rim members include a continuous closed rim surface around the entire perimeter of the sides and ends of the basket which is level and has no interruptions or discontinuities.

The top and bottom rim members are vertically aligned and co-extend peripherally with one another permitting normal stacking of a bottom rim surface upon a top rim surface of a bottom basket and inverted stacking of a top rim surface upon a top rim surface of a bottom basket. The contacting rim surfaces are in uniform total perimeter contact around the entire perimeter of the basket. The bearing load on the stacked baskets is evenly distributed about the rims and basket perimeter reducing basket distortion caused by improper load distribution.

Referring now in more detail to the drawings, a furnace basket 10 is illustrated as including vertically spaced top and bottom rim members A and B. Frame means C includes opposing frame sides 20*a* and 20*c* and ends 20*b* and 20*d* vertically connected between rim members A and B in any suitable manner such as by welding. Rim A is defined by a continuous closed loop 12 which includes side legs 12*a* and 12*c* and end legs 12*b* and 12*d*, which is preferably one-piece. Rim B is defined by a loop 14 which includes side legs 14*a* and 14*c* and end legs 14*b* and 14*d*. Rim loop A includes a load bearing rim surface 16 around the entire perimeter of the sides and ends of the top of the basket. Bottom rim loop B includes a contacting rim surface 18 around the sides and ends at the bottom periphery of the basket. Load bearing rim surfaces 16 and 18 provide total perimeter contact between the respective rim surfaces of stacked baskets and even load distribution around the basket perimeter.

Figure 2:
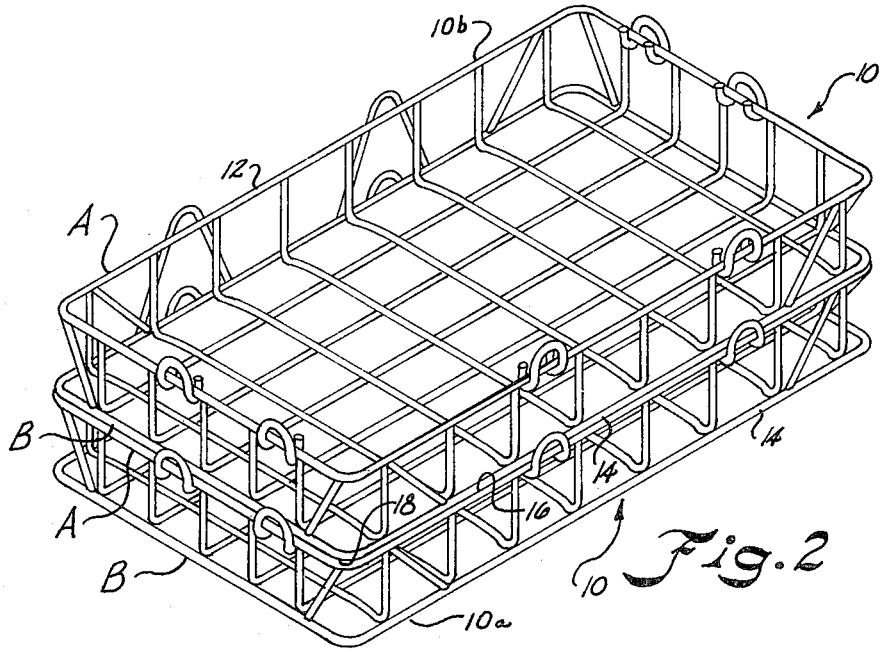
FIG. 2 is a perspective view illustrating a pair of furnace baskets in a normal stacked configuration.
Figure 6:
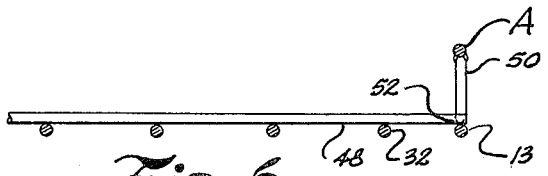
FIG. 6 is a partial sectional view of an alternate construction of a bottom basket floor according to the invention.

In a normal position, as best seen in FIG. 2, basket 10*a* is positioned below basket 10*b* with the bottom rim surface 18 of basket 10*b* contacting the top load bearing rim surface 16 of basket 10*a* around the entire perimeter of both baskets. A finer wire mesh basket such as shown in U.S. Pat. No. 2,807,454 is normally placed inside the furnace basket 10 to hold and contain the smaller workpieces.

A bottom grid floor 30 includes a plurality of elongated bottom runner elements 32 which include a horizontal run 34 and a generally ninety degree bend 36 formed in the element. A vertical run 38 extends from the bend 36 terminating at the top rim A and are integrally attached such as by welding.

Figure 5:
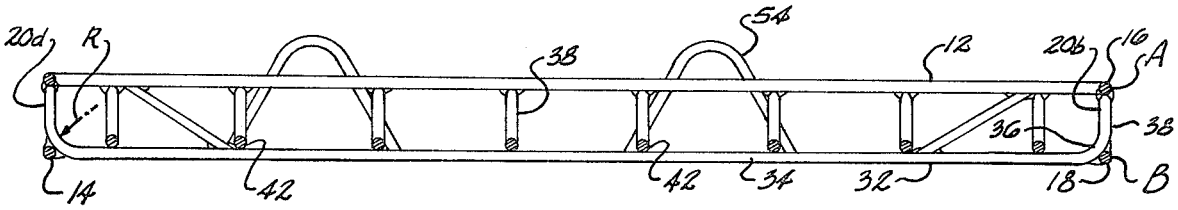
FIG. 5 is a side sectional view taken along line 5—5 of FIG. 1.

As can best be seen in FIG. 5, the bend 36 is made such that the bottom rim contacting surface 18 is flush with the bottom of the horizontal runs 34 of the bottom element 32. It has been found that the inside radius R of bend 36 may be advantageously made as a function of the rim diameter D of bottom rim B and the diameter d of the bottom runner 32 according to the formulation $R=5.8343\ D-2d$. In so doing, the bottom surfaces of bottom runners 32 and bottom surface 18 of rim B provide a generally perfect flat basket bottom surface which evenly distributes loads exerted on it by an upper stacked basket as well as the loads which the bottom exerts on the top rim of a lower basket. The above described bend radius also provides a sufficiently large bend radius that tends to avoid cracking from the inside out as often occurs in sharp bends repeatedly under stress. Load distributions on the basket are enhanced since each horizontal run 34 has a corresponding vertical run 38 in direct load transmission relation such that the loads are evenly transmitted and carried among the structural members. Vertical element 38 extending from bend 36 is shorter than a corresponding straight vertical section wherein by a smaller bending moment is produced by the element. The vertical runs 38 form vertical element of the ends 20*b* and 20*d* of the frame means C.

The bottom grid floor is further defined by cross runner elements 40 which include a horizontal run 42 lying across and atop the bottom runner element 32. The cross runner elements further include a vertical run 44 which form a part of the sides 20*a* and 20*c* of the frame means C. In a preferred embodiment, the cross runner element 40 includes a downwardly bent elbow portion 46 which joins the horizontal run 42 and vertical run 44 as one piece. As best seen in FIG. 5, the elbow portion 46 also joins the bottom rim B. The elbow portion 46 extends vertically past the plane of the horizontal run 42 of the cross run element 40 but does not extend beyond the plane of the bottom rim B or the bottom runner element 32.

Figure 3:
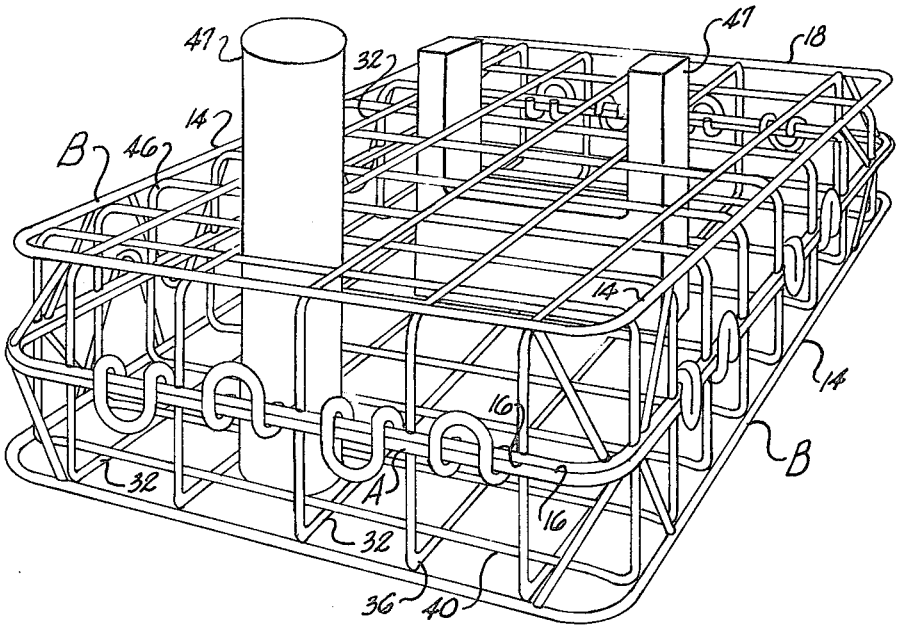
FIG. 3 is a perspective view illustrating a pair of furnace baskets in an inverted stacked configuration.
Figure 4:
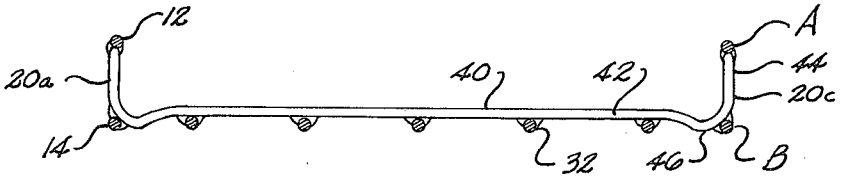
FIG. 4 is an end sectional view taken along line 4—4 of FIG. 1.

When stacked in an inverted position, as best seen in FIG. 3, elongated work peices 47 may be vertically held between the open grid spaces of stacked basket floors 30.

In an alternate embodiment, the cross runner elements are illustrated as including horizontal runs 48 which extend across and atop the bottom runners 32 and include vertical elements 50 extending between the top and bottom rim members to which the horizontal runners 48 are fixed. As illustrated, the horizontal runners 48 lie across the top of the bottom rim member B and are fixed at a junction 52 of the vertical element 50 and the bottom of the rim member B.

Stacking retaining means are carried by the basket for engaging opposing rim members when the baskets are in a stacked configuration either in a normal or inverted configuration. The stacking retaining means includes a plurality of retaining devices 54 carried on side 20*a* of the basket and a plurality of retaining devices 56 carried on opposing side 20*c* of the basket. A plurality of stacking retaining devices 58 are carried on end 20*b* of the basket and stacking devices 60 are carried on the opposing end 20*d* of the basket. It will be noted that the stacking devices 54 are staggered with respect to the stacking devices 56 carried on an opposing side and that the stacking devices 58 are staggered with respect to the devices 60 on opposing ends.

The staggered positions of the stacking devices permit the baskets to be inverted and be stacked upon each other as illustrated in FIG. 3 without the stacking devices abutting each other as would be the case if the stacking devices were in alignment. Rim B provides a reinforced solid loop around the entire perimeter which the retaining means of a lower basket engage to resist inward sagging.

Thus, it can be seen that an advantageous construction for a high temperature furnace basket can be had according to the present invention which virtually eliminates basket distortion due to high temperature stresses and improper load distribution between stacked baskets. The present design permits maximum load bearing between the contact surfaces of the basket with minimum basket weight. Distortion of sides and ends is reduced by maintaining total rim supporting contact. The basket construction together with the stacking retaining means reduces the lateral sagging of the sides and ends of the basket of often occurs in the prior constructions which often leads to unstable stacking and shortened basket life.

While a preferred embodiment of the invention has been described using specific terms, such description is for illustrative purposes only, and it is to be understood that changes and variations may be made without departing from the spirit or scope of the following claims.

What is claimed is:

1. A stackable distortion-resistant furnace basket comprising:

an open top;

a closed bottom having an open grid floor;

a top rim member extending around the perimeter of said top;

a bottom rim member extending around the perimeter of said bottom;

vertical frame means including opposing sides and ends integrally connecting said first and second rim members;

said top rim member having a continuous closed uninterrupted load bearing rim surface around the entire perimeter of said sides and ends;

said bottom rim member having a continuous closed uninterrupted contacting rim surface around the entire perimeter of said sides and ends;

said top and bottom rim members co-extending in vertical alignment with one another permitting normal stacking of a bottom rim surface of one basket upon a top rim surface of another basket and inverted stacking of a top rim surface upon a top rim surface of another basket; and said rim surfaces contacting one another in said normal and inverted stacked configurations around the total perimeter of said sides and ends of said baskets thereby distributing loads evenly and reducing basket distortion;

a plurality of elongated bottom runner elements including a horizontal run extending across said basket bottom, a generally ninety-degree bend formed in said element, and a vertical run extending from said bend terminating at said top rim member, said bottom runner element having a bottom surface lying in the same general plane as said bottom rim surface, said bend portion curving upwardly out of said plane and contacting said bottom rim member being affixed thereto at said contact point before terminating in said vertical run;

a plurality of elongated cross runner elements extending transversely across said bottom runner elements being integral with said side frame means.

2. The basket of claim 1 wherein said cross runner elements include a horizontal run lying atop said bottom rummer elements, a vertical run and a bent elbow portion joining said horizontal and vertical runs.

3. The basket of claim 2 wherein said elbow portion is bent vertically beyond the plane of said horizontal run of said cross runner element.

4. The basket of claim 1 wherein said cross runner elements include horizontal runs extending across and atop said bottom runners and are affixed to vertical elements of said side frame means.

5. The basket of claim 4 wherein said horizontal runs of said cross runner elements lie atop said bottom rim members and are affixed at a junction of said vertical element and said bottom rim member.

6. The basket of claim 1 including stacking retaining means carried by said top rim member engaging an opposing rim member of a stacked basket retaining same in said stacked configuration and opposing lateral distortion of said rim member and side and ends of said frame means.

7. The basket of claim 6 wherein said stacking retaining means includes retaining members carried on said opposing sides, ends and corners of said basket, said retaining members being staggered with respect to the retaining members being carried on opposing sides and ends permitting stacking in said normal and inverted configuration.

8. The basket of claim 1 wherein the radius of bend of said bend portion is a function of the diameters of said bottom horizontal run and said bottom rim member.

9. The basket of claim 8 wherein said radius of bend is approximated by the formation $R=5.8343\ D-2d$ where D is the diameter of the bottom rim and d is the diameter of the horizontal rim.

10. A stackable distortion-resistant furnace basket comprising:

an open top;

a closed bottom having an open grid floor;

a top rim member extending around the perimeter of said top;

a bottom rim member extending around the perimeter of said bottom;

vertical frame means including opposing sides and ends integrally connecting said first and second rim members;

said top rim member having a continuous closed uninterrupted load bearing rim surface around the entire perimeter of said sides and ends;

said bottom rim member having a continuous closed uninterrupted contacting rim surface around the entire perimeter of said sides and ends;

said top and bottom rim members co-extending in vertical alignment with one another permitting normal stacking of a bottom rim surface of one basket upon a top rim surface of another basket and inverted stacking of a top rim surface upon a top rim surface of another basket;

said rim surfaces contacting one another in said normal and inverted stacked configurations around the total perimeter of said sides and ends of said baskets hereby distributing loads evenly and reducing basket distortion; and said bottom grid floor including a plurality of elongated bottom runner elements extending across said basket bottom generally co-planar with said bottom rim member;

a plurality of cross runner elements including a horizontal run extending across said bottom runner elements, a vertical run extending between said top and bottom rim members, and an elbow bend portion joining said horizontal and vertical runs;

said elbow bend portion extending downwardly past the plane of said horizontal runs and curving upwardly to contact said bottom rim member being affixed thereto at the contact point prior to extending into said vertical run so that a unitary construction is provided.

* * * * *